US005269603A

United States Patent [19]

Lisi et al.

[11] Patent Number: 5,269,603

[45] Date of Patent: Dec. 14, 1993

[54] TETHERABLE FRAMEWORK FOR, AND IN COMBINATION WITH, A SUBMERSIBLE MIXER

[75] Inventors: Dominic A. Lisi; Michael T. Lozinak, both of Trumbull, Conn.

[73] Assignee: ITT Corporation, New York, N.Y.

[21] Appl. No.: 19,321

[22] Filed: Feb. 18, 1993

Related U.S. Application Data

[63] Continuation of Ser. No. 853,633, Mar. 18, 1992, abandoned.

[51] Int. Cl.[5] ..... B01F 5/10

[52] U.S. Cl. ..... 366/261; 366/286; 366/343

[58] Field of Search ..... 114/121, 312, 315, 331; 134/167 R, 169 R; 187/1 R, 9 R, 20, 21; 248/317, 327, 329, 669, 671, 672, 676, 678, 505; 294/66.1, 67.1, 67.2, 67.22, 67.3, 67.4, 6.77; 366/241, 261-265, 279, 285, 286, 341-343, 349, 139; 405/185; 47/360, 423.15

[56] References Cited

U.S. PATENT DOCUMENTS

| | | | |
|---|---|---|---|
| 3,332,716 | 7/1967 | Gridley | 294/67.1 |
| 3,626,703 | 12/1971 | Richburg | 114/312 |
| 3,856,272 | 12/1974 | Ravitts | 366/261 |
| 4,178,139 | 12/1979 | Seppanen | 417/360 |
| 4,410,279 | 10/1983 | Howden | 366/263 |
| 4,416,549 | 11/1983 | Kretschmer | 366/286 |
| 4,456,924 | 6/1984 | Avaoka | 366/263 |
| 4,503,942 | 3/1985 | Anden | 417/360 |
| 4,511,257 | 4/1985 | Roberts | 366/286 |
| 4,522,118 | 6/1985 | Simonsen | 366/139 |
| 4,581,182 | 4/1986 | Cramer | 366/261 |
| 4,687,175 | 8/1987 | Szendroi | 248/661 |
| 4,721,055 | 1/1988 | Pado | 114/330 |
| 4,721,275 | 1/1988 | Benton | 248/677 |
| 4,721,392 | 1/1988 | Fries | 366/241 |
| 4,746,221 | 5/1988 | Okumura | 366/349 |
| 4,808,040 | 2/1989 | Lisi | 366/343 |
| 5,192,047 | 3/1993 | Lisi et al. | 248/676 |

FOREIGN PATENT DOCUMENTS

| | | | |
|---|---|---|---|
| 2025564 | 1/1980 | United Kingdom | 134/167 R |

*Primary Examiner*—Philip R. Coe
*Assistant Examiner*—Terrance R. Till
*Attorney, Agent, or Firm*—M. J. Lombardi

[57] ABSTRACT

Simple, narrow bands are secured to a generally planar platform, and joined together, above the platform, by a tether-attaching bolt. The bolt mounts a lifting eye for a hook and tethering cable. One of the bands and the platform, receive mixer-mounting bolts for replaceably fixing the mixer on the platform. To inhibit unwanted migration of the apparatus across the bottom of a liquid-confining tank or reservoir, the platform has pointed-end feet depending therefrom, and removable weights are set atop the bands, whereat the latter are joined together.

15 Claims, 2 Drawing Sheets

TETHERABLE FRAMEWORK FOR, AND IN COMBINATION WITH, A SUBMERSIBLE MIXER

This application is a continuation of application Ser. No. 07/853,633, filed Mar. 18, 1992, and now abandoned.

This invention pertains to apparatus for agitating fluids, principally liquids, and in particular to mixers, for agitating liquids in tanks or reservoirs, which are submersible in the liquids, and to means for supporting such mixers for submersion.

BACKGROUND OF THE INVENTION

Submersible mixers and means for supporting them in tanks or reservoirs of liquid are known in the prior art. Exemplary thereof is the arrangement disclosed in U.S. Pat. No. 4,687,175, issued on Aug. 18, 1987, to Balint Szendroi, et al, for an Attaching Device. The latter disclosed a mast system which is emplaced in the tank or reservoir, and to which the mixer is attached. The mixer can be articulated, relative to the mast system, and caused to translate therealong as well. The same is very versatile, and equal to substantially any fluid agitating requirement. There are fluid mixing needs, however, which do not warrant the expense and sophistication of such mixer/mast systems. Adequate for such needs would be a submersible mixer which can be supported in a framework and lowered into the tank or reservoir by means of a tethering cable.

U.S. Pat. No. 3,856,272, issued to Richard B. Ravitts, on Dec. 24, 1974, sets forth a floating mixer. The same does not accommodate for the submersion of the mixer wholly within the tank- or reservoir-confined liquid. U.S. Pat. No. 4,410,279, issued on Oct. 18, 1983 to Michael Howden, et al, for an Apparatus for Agitating the Contents of Storage Tanks; U.S. Pat. No. 4,456,424, for an Underwater Sand Pump, issued to Toshinobu Araoka, on Jun. 26, 1984; and the U.S. Pat. No. 4,746,221, issued on May 24, 1988, to Katsuji Okumura, for a Stirrer for Use in Liquid Storage Tanks, all set forth submersible agitators for liquids which are tetherable. However, the agitator or mixer housings and allied structures thereof are quite complex, and likely to be as expensive as the aforesaid mixer/mast system, if not more expensive.

To meet the need for a simple, inexpensive and versatile tetherable frame for a submersible mixer, and the combination of such a frame with a mixer replaceably mounted thereto, D. Lisi and R. Deilus filed their U.S. patent application, Ser. No. 07/827,174, on Jan. 28, 1992, for a Tetherable Frame for, and in Combination with, a Submersible Mixer. In the instant application is disclosed a tetherable framework for a submersible mixer, and in combination with such a mixer, as versatile as the invention set out in the aforesaid application, and of even simpler structure, and having further, novel features.

It is an object of this invention, then, to set forth a tetherable framework for a submersible mixer comprising a generally planar platform; a pair of bands (a) fixed to, and upstanding from said platform, and (b) in traversing engagement with each other above said platform; and tether-attaching means coupled to said bands and fastening said bands together in the aforesaid traversing engagement thereof.

Further is it an object of this invention to set forth, in combination, a submersible mixer, and a tetherable framework therefor, comprising a generally planar platform; a pair of bands (a) fixed to said platform, and upstanding therefrom, and (b) in traversing engagement with each other above said platform; tether-attaching means coupled to said bands, and fastening said bands together in the aforesaid traversing engagement thereof; and a submersible mixer coupled to said platform and to at least one of said bands.

SUMMARY OF THE INVENTION

The aforesaid objects of this invention, as well as the novel features thereof, which will become apparent hereinafter, are accomplished by the provisioning of a generally planar platform, and fixing a pair of bands to the platform for upstanding elevation thereof from the platform and crossing or traversing engagement with each other above the platform, and fixing them together, as aforesaid, by means of a tether-attaching means.

BRIEF DESCRIPTION OF THE DRAWINGS

The above-mentioned and other features and objects of this invention will become more apparent by reference to the following description taken in conjunction with the accompanying figures, in which.

DETAILED DESCRIPTION OF THE PREFERRED EMBODIMENT

Figure 2:
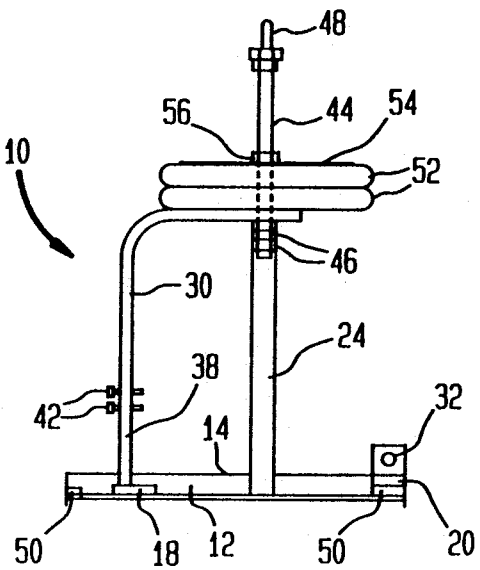
FIG. 2 is a side, elevational view of the framework of FIG. 1, taken from the left-hand side of FIG. 1.
Figure 3:
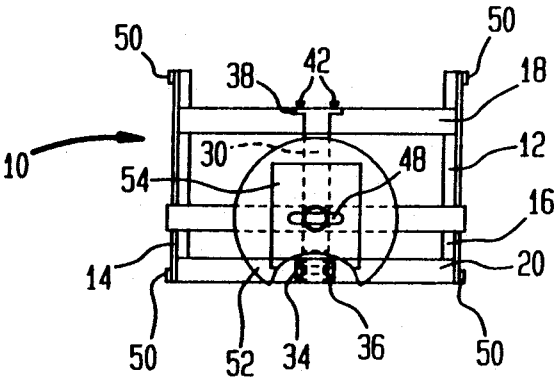
FIG. 3 is a plan view of the framework of FIGS. 1 and 2, taken from the top of FIG. 1.
Figure 1:
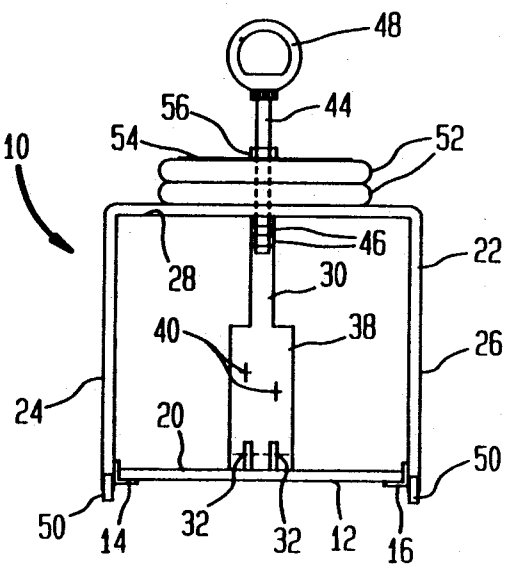
FIG. 1 is a front, elevational view of the novel framework according to an embodiment thereof.

As shown in FIGS. 1 through 3, the novel framework 10 has a platform 12, of generally planar conformation, formed of parallel channel members 14 and 16, with spreader members 18 and 20 secured to the channel members. A first band 22, of parallel limbs 24 and 26, with a joining section 28, is set astride the platform 12. Ends of the limbs 24 and 26 are secured to the channel members 14 and 16, and section 28 parallels the platform 12. A second band 30 has an end thereof secured to spreader member 18, a portion thereof, upstanding from the platform, in parallel with limbs 24 and 26, and the other end thereof is turned inward, relative to the platform 12, in traversing or crossing engagement with section 28.

Fixed upon spreader member 20 are upstanding, apertured, bolt lugs 32, which receive the mixer-securing bolt and nut 34 and 36, respectively. Band 30 has a widened panel-like portion 38 with fastener holes 40 formed therein for fasteners 42. Fasteners 42 cooperate with the bolt and nut 34 and 36 to secure a mixer in place in the framework 10.

Where bands 22 and 30 are in crossed or traversed engagement, above the platform 12, they are apertured to receive an elongate bolt 44. The bolt 44 receives nuts 46 on the end thereof, below section 28 of band 30. To the opposite end of the bolt 44 is engaged a lifting eye 48. The latter is provided as a means for attaching thereto a hook and a tethering cable.

If the flat surfaces of the channel members 14 and 16 were to rest directly upon the bottom of a liquid-confining tank or reservoir, the torque developed by a mixer mounted in the framework 10 would tend to cause the platform 12 to hydroplane on the aforesaid flat surfaces. To inhibit this occurrence, the platform 12 has feet 50 depending therefrom which effect only point contacts with a bearing surface, i.e., the bottom of a tank or reservoir. The feet 50 have pointed ends or terminations for engaging such bearing surface. In addition, to resist such torque-induced motion of the framework 10 (and mixer), it is a teaching of this invention to weight down the framework 10 with selective weights.

Weights 52 are centrally apertured, to receive bolt 44 therethrough, and rest upon the bands 22 and 30 atop the framework 10. A securing plate 54, best seen in FIG. 3 (where portions of the plate and weights are cut away to show the bolt lugs 32), is set upon the topmost weight 52, and a nut 56 is turned down, along bolt 44, against the plate 54.

In liquids which are significantly viscous, it will be found necessary to add weights 52, to inhibit the propelling of the framework 10 and mixer within and across the bottom of the tank or reservoir in which they are disposed. The addition and or removal of weights 52 is easily done, simply by removing the lifting eye 48, nut 56, and the plate 54.

Figure 4:
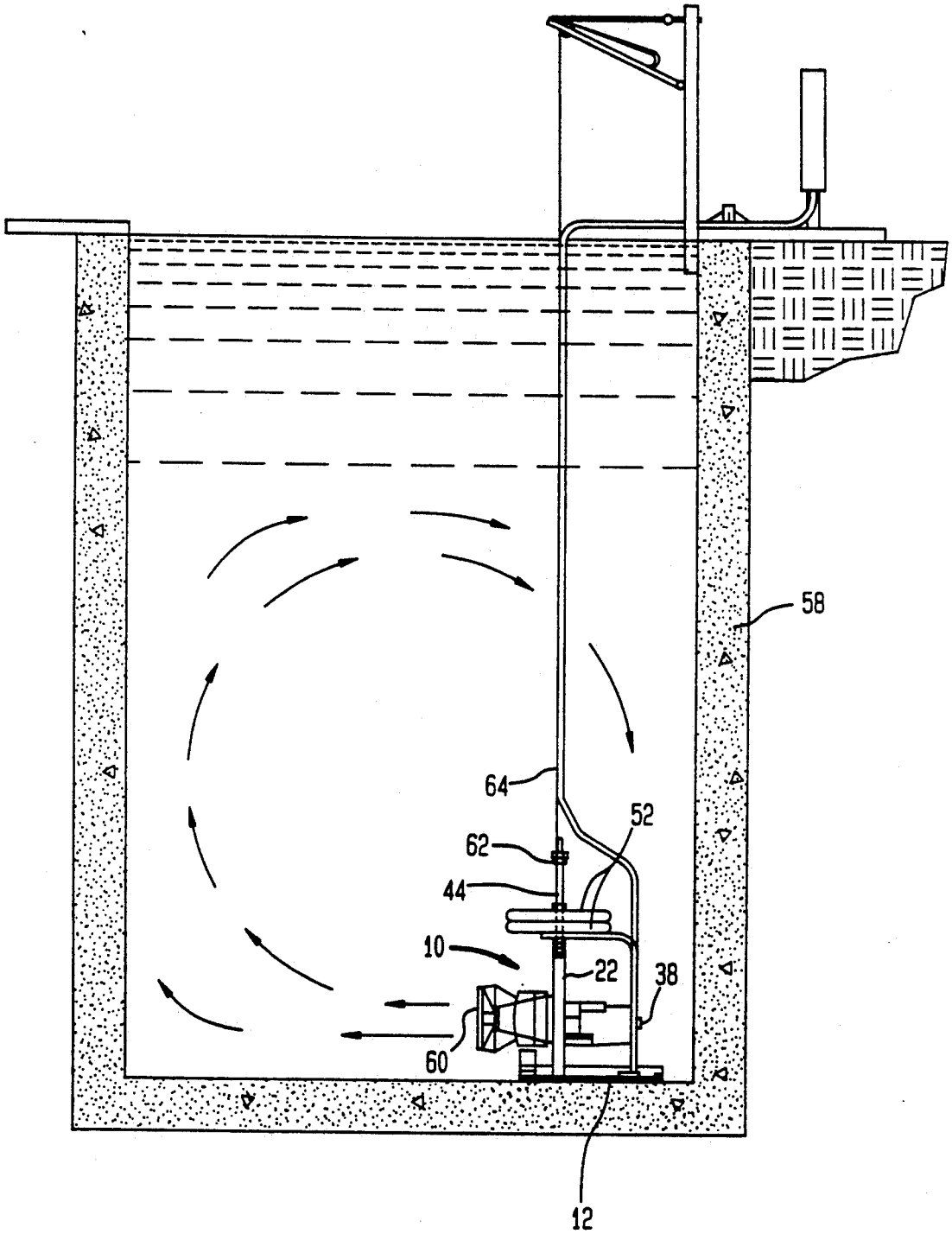
FIG. 4 is an illustration of the framework showing the mixer in place thereon, and a tethering cable and hook coupled to the lifting eye.

FIG. 4 shows the framework 10 within a tank 58, with a mixer 60 secured to the platform 12 and the panel-like portion 38 of band 30, and a hook 62 and tethering cable 64 (and mixer power lines) coupled thereto.

The framework 10 is of very simple, albeit sturdy structure, defines an open structure which accommodates for free flow of liquid therethrough, offers an ease of mounting and demounting of the mixer 60, and through the point-ended feet 50 and weights 52, minimize the possibility of the mixer torque causing the apparatus to traverse the bottom of the tank 58.

While we have described our invention in connection with a specific embodiment thereof, it is to be clearly understood that this is done only by way of example and not as a limitation to the scope of the invention as set forth in the object thereof and in the appended claims.

We claim:

1. A tetherable framework in combination with a submersible mixer and a liquid-confining tank or reservoir which has a bottom bearing surface, comprising:

a generally planar platform contacting the bearing surface of such tank or reservoir;

a pair of bands (a) fixed to, and upstanding from said platform, and (b) in traversing engagement with each other above said platform; and tether-attaching means coupled to said bands and fastening said bands together in the aforesaid traversing engagement thereof; wherein said platform has means attaching said submersible mixer thereto;

means resisting a mixer-torque-caused movement of said framework about such bearing surface; and means, joined to said platform, inhibiting hydroplaning movement of said framework upon such bearing surface.

2. A tetherable framework, according to claim 1, wherein:

said hydroplaning movement inhibiting means comprises point contact effecting means for effecting only point contacts with the bearing surface.

3. A tetherable framework, according to claim 2, wherein:

said point contacts effecting means comprises a plurality of feet depending from said platform; and all of said feet have pointed terminations.

4. A tetherable framework, according to claim 1, wherein:

said tether-attaching means comprises an elongate bolt which has a lifting eye at one end thereof.

5. A tetherable framework, according to claim 4, wherein:

said bolt is in penetration of said bands.

6. A tetherable framework, according to claim 5, further including:

weighting means surmounting said bands for weighting said framework; wherein said weighting means comprises at least one weight having a bore formed therein centrally thereof; and said bolt is in penetration of said bore.

7. A tetherable framework, according to claim 1, wherein:

said hydroplaning movement inhibiting means comprises a plurality of feet depending from said platform, which feet all have pointed terminations.

8. A tetherable framework, according to claim 1, wherein:

said mixer-torque-caused movement resisting means comprises weighting means surmounting said bands for weighting said framework.

9. A tetherable framework, according to claim 8, wherein:

said weighting means comprises at least one weight made fast to said bands.

10. In combination, a submersible mixer, and a tetherable framework therefor, including a liquid-confining tank or reservoir which has a bottom bearing surface, comprising:

a generally planar platform contacting the bearing surface of such tank or reservoir;

a pair of bands (a) fixed to said platform, and upstanding therefrom, and (b) in traversing engagement with each other above said platform;

tether-attaching means coupled to said bands, and fastening said bands together in the aforesaid traversing engagement thereof;

a submersible mixer coupled to said platform and to at least one of said bands;

means resisting a mixer-torque-caused movement of said framework about such bearing surface; and means, joined to said platform, inhibiting hydroplaning movement of said framework upon such bearing surface.

11. The combination, according to claim 10, wherein:

said hydroplaning movement inhibiting means comprises point contact effecting means for effecting only point contacts thereof with the bearing surface.

12. The combination, according to claim 11, wherein:

said point contacts effecting means comprises a plurality of feet depending from said platform; and all of said feet have pointed terminations.

13. The combination, according to claim 10, wherein:

said hydroplaning movement inhibiting means comprises a plurality of feet depending from said platform, said feet all having pointed terminations.

14. The combination, according to claim 10, wherein:

said mixer-torque-caused movement resisting means comprises weighting means surmounting said bands for weighting said framework.

15. The combination, according to claim 14, wherein:

said weighting means comprises at least one weight made fast to said bands.

* * * * *